United States Patent [19]

Glover et al.

[11] Patent Number: 4,846,727

[45] Date of Patent: Jul. 11, 1989

[54] REFERENCE CONDUCTOR FOR IMPROVING SIGNAL INTEGRITY IN ELECTRICAL CONNECTORS

[75] Inventors: Douglas W. Glover; Richard F. Granitz, both of Harrisburg, Pa.

[73] Assignee: AMP Incorporated, Harrisburg, Pa.

[21] Appl. No.: 179,589

[22] Filed: Apr. 11, 1988

[51] Int. Cl.[4] ..... H01R 13/648

[52] U.S. Cl. ..... 439/608; 439/108

[58] Field of Search ..... 439/95, 108, 607, 608

[56] References Cited

U.S. PATENT DOCUMENTS 4,558,917 12/1985 Kamono et al. ..... 439/95 X 4,611,867 9/1986 Ichimura et al. ..... 439/608 X 4,711,506 12/1987 Tanaka ..... 439/108

4,712,849 12/1987 Seidel et al. ..... 439/607

*Primary Examiner*—Neil Abrams

*Assistant Examiner*—Stephen Zagrobelny

*Attorney, Agent, or Firm*—Allan B. Osborne

[57] ABSTRACT

A reference conductor for improving signal integrity in connectors and connector systems. More particularly the reference conductor includes a conductive plate positioned between adjacent rows of signal conductors in a connector and which is electrically connected to reference circuits on substrates associated with the connector to provide a low inductance signal return path.

14 Claims, 9 Drawing Sheets

70
76
74
90
62
72
26
32
86
18
16
36
82
88
46
52
82
88
26
84
40
86
24
50
24
10
12
14
22
22
102
100
80
78
100
103
102
92
96
96
98
98
94

REFERENCE CONDUCTOR FOR IMPROVING SIGNAL INTEGRITY IN ELECTRICAL CONNECTORS

FIELD OF THE INVENTION

The invention disclosed herein relates to the maintenance of signal integrity in high density connectors and connector systems used in association with printed circuit boards, circuit cards, backpanels and other like substrate.

BACKGROUND OF THE INVENTION

Contemporary electronic circuits require carefully designed transmission paths to preserve signal integrity and minimize interference from foreign sources. One contemporary connector system, disclosed in U.S. Pat. No. 4,451,107, utilizes die cast zinc housings to provide grounding and EMI shielding. Another comtemporary connector system, disclosed in U.S. Pat. No. 4,655,518, employs ground contacts located on the outside of and parallel to columns of signal contacts to provide short ground paths and thereby promote signal integrity.

As switching speeds become even higher, signal integrity becomes more critical and the maintenance thereof must include provisions for the following: (a) low inductance signal return conductors to control common impedance noise generation; (b) a strong coupling of the signal conductors to their return conductors electrostatically and electromagnetically in relation to the coupling between proximate signal conductors in order to control crosstalk; and (c) a coupling relationship between signal conductors and signal return conductors which provides an impedance which matches the impedance of the source and load circuits in order to minimize signal reflections.

It is now proposed to provide in connectors and connector systems a low inductance (at high frequencies) signal return path in the form of a reference conductor (plate) between rows of signal conductors. Such a conductor, which is the form of a plate, will provide the essential element required in maintaining the signal integrity discussed above.

SUMMARY OF THE INVENTION

According to the invention, a reference conductor for improving signal integrity in connectors and connector systems is provided. The reference conductor, in the form of a plate of conductive material, is positioned between rows of signal conductors in a connector to provide a low inductance signal return path. Further, the plate is electrically connected through reference conductors to reference circuits on substrates associated with the connector and connector systems.

DESCRIPTION OF THE INVENTION

Figure 1:
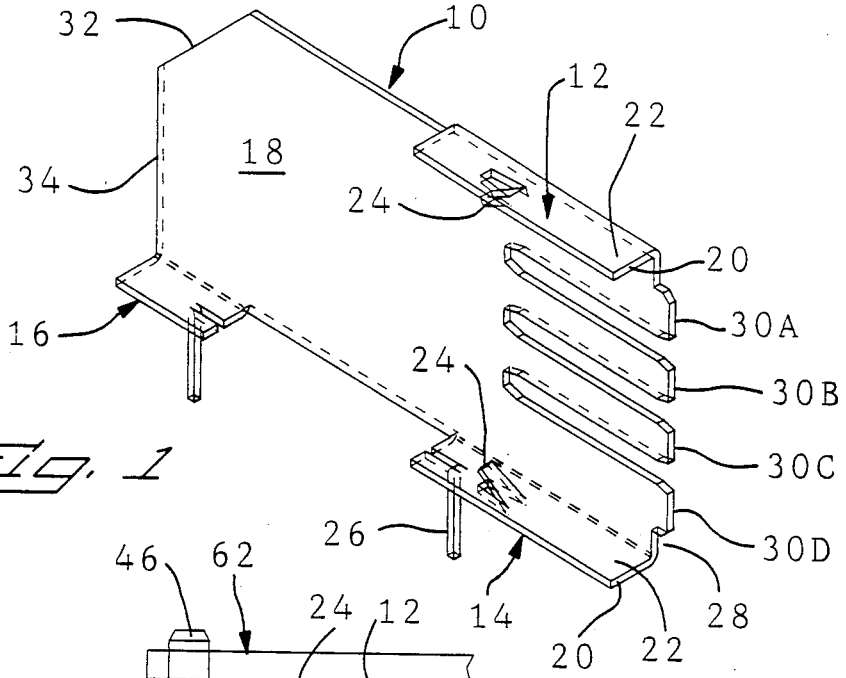
FIG. 1 is a perspective view of a reference plate of the present invention.
Figure 4:
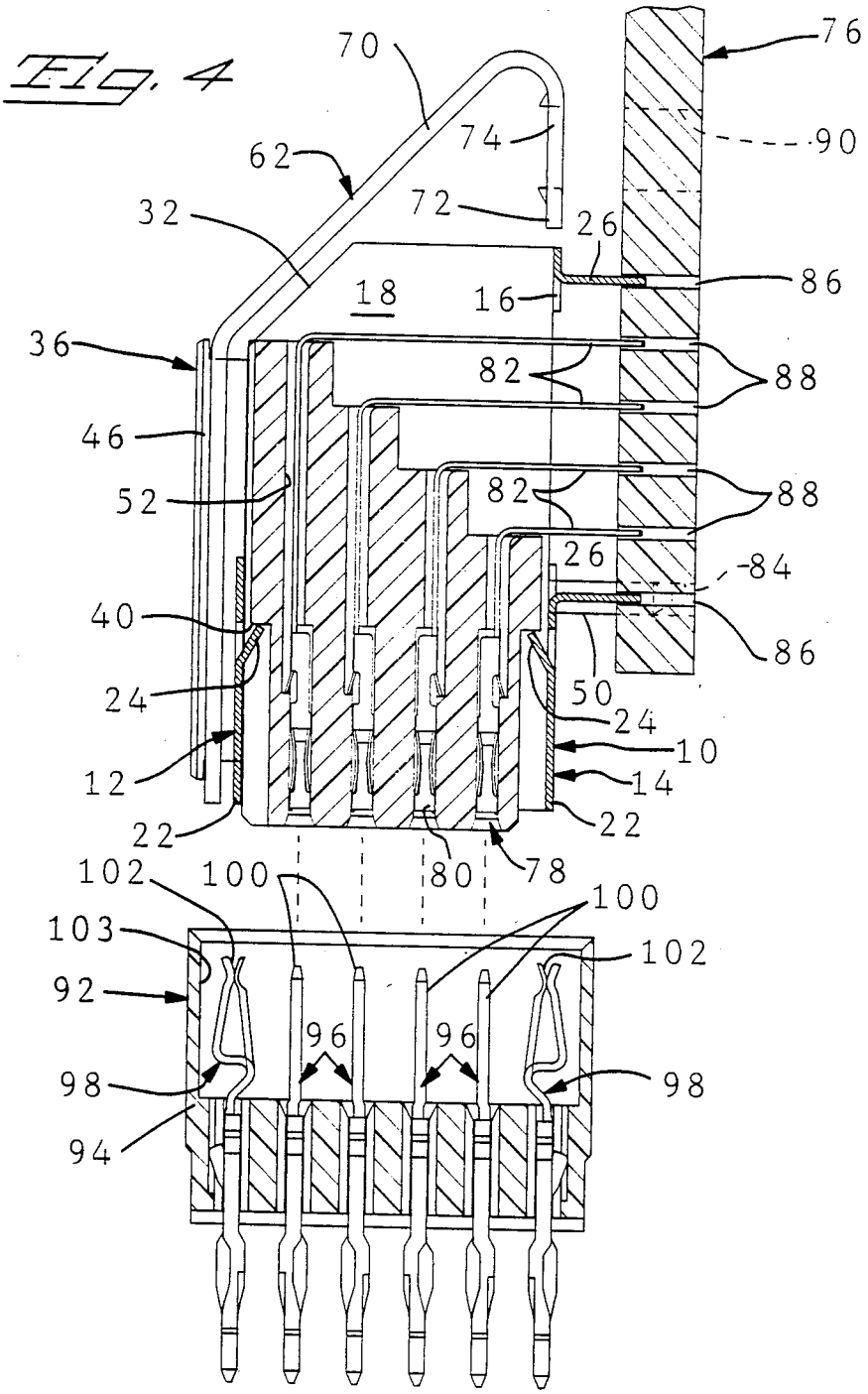
FIGS. 4 and 5 are side sectioned views of the unit of FIG. 3 and a second connector to which the first connector is mated.

Reference conductor or plate 10 shown in FIG. 1 is preferably stamped and formed from suitable conductive material such as copper. In the embodiment shown, plate 10 includes side portions 12, 14 and 16 bent at ninety degrees relative to web 18 extending therebetween. Free ends 20 of side portions 12, 14 provide tab terminals 22 for engaging reference contacts 98 housed in connector 92 (FIG. 4). Lances 24, struck from side portions 12, 14 and bent obliquely inwardly; i.e., towards each other, are for use in retaining plate 10 in connector housing 38 as shown in FIG. 4. Posts 26, struck from side portions 14, 16 and bent outwardly ninety degrees relative thereto, are adapted for insertion into holes 86 in substrate or card 76 (FIG. 4). Equivalent devices to posts 26 would include leads (not shown) adapted for surface mounting to conductive pads (not shown) on card 76.

Free end 28 of web 18 is slotted to provide four fingers 30A, B, C and D. As more clearly shown in FIGS. 2 and 4, corner 32 of opposite free end 34 is diagonally cut to provide clearance for support member 62.

Figure 2:
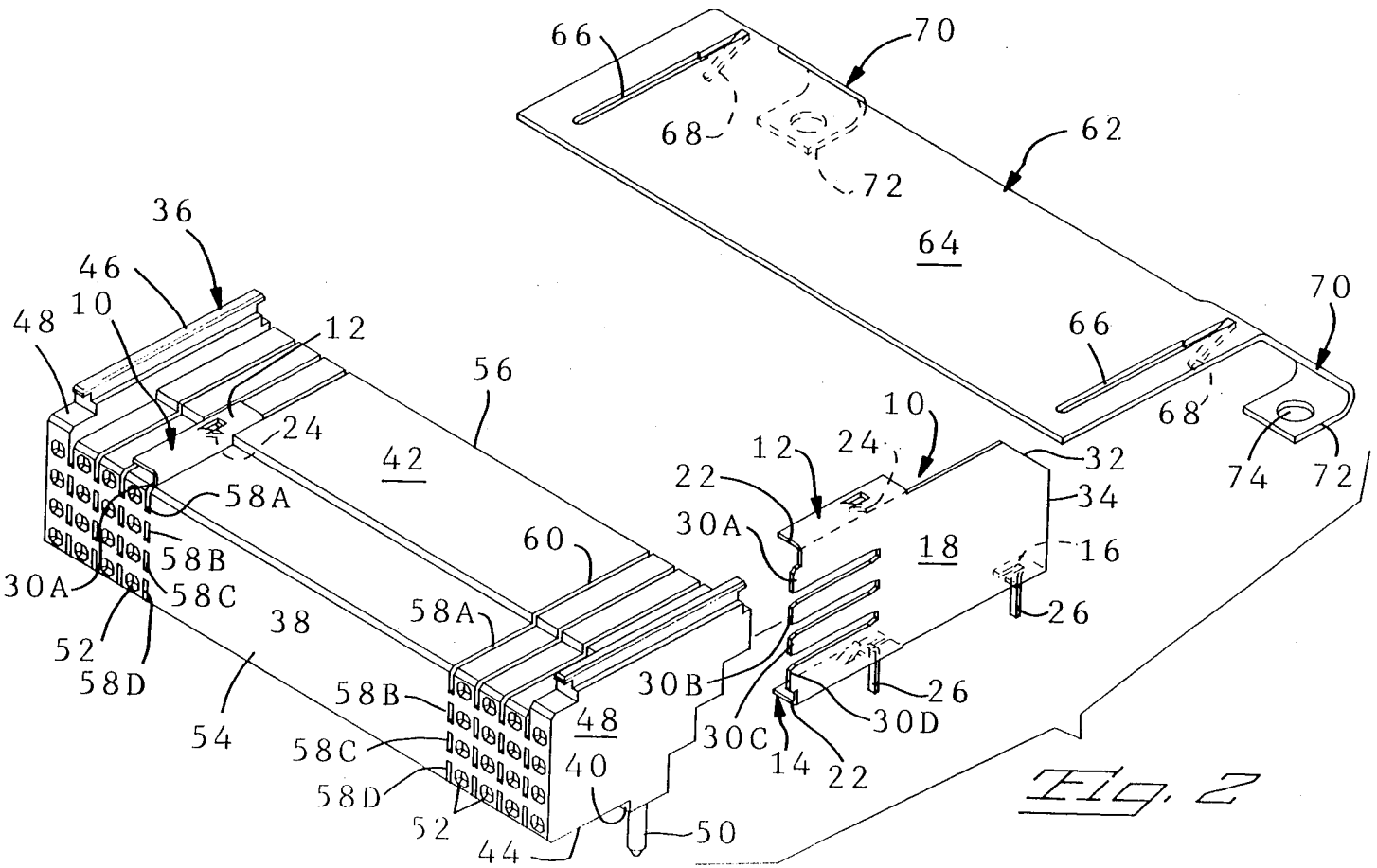
FIG. 2 is a perspective view of the reference plate, a first connector in which the plate is employed and a support member.
Figure 5:
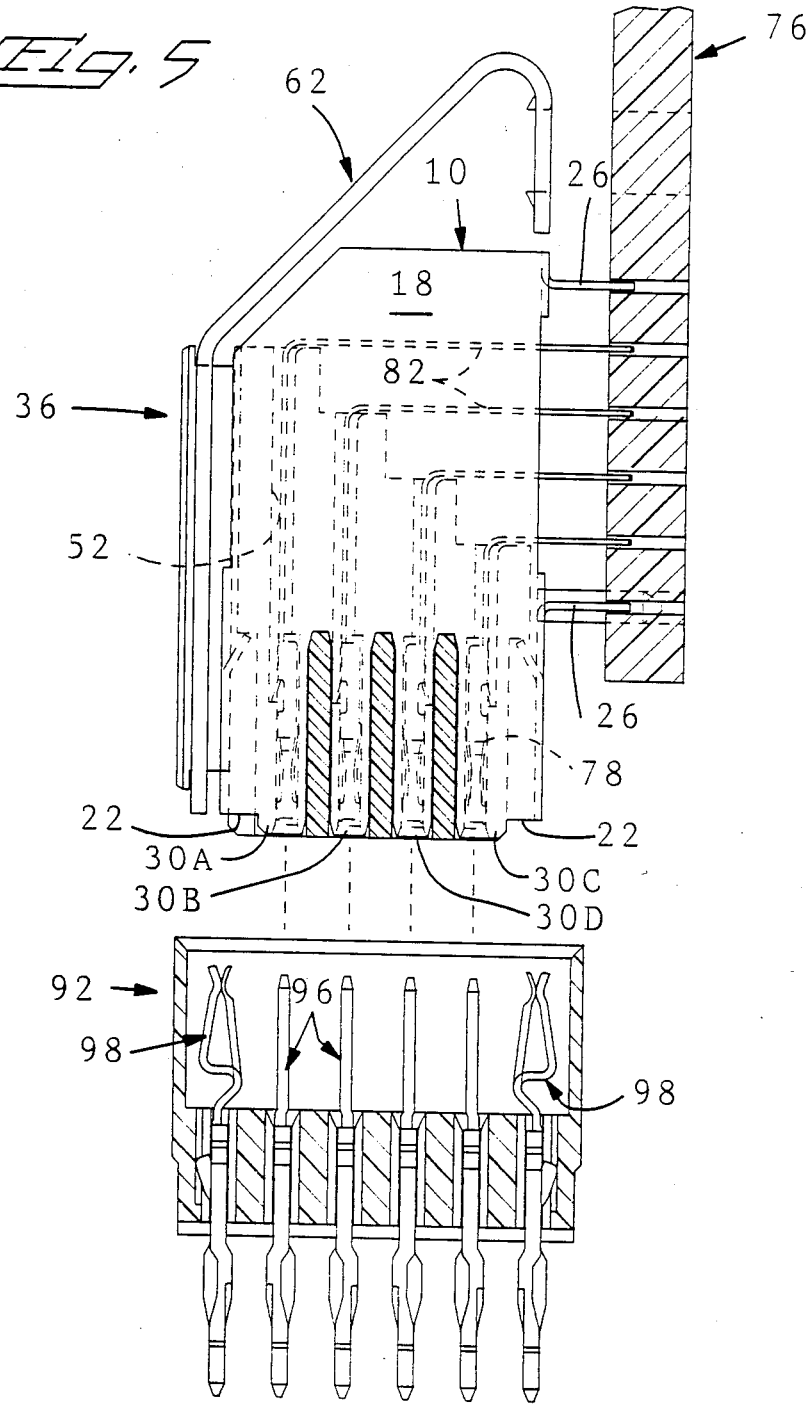

FIG. 2 shows first connector 36 in which reference plate 10 is positioned. Housing 38 of connector 36 includes longitudinally extending shoulders 40 on sidewalls 42, 44, positioning rails 46 on sidewall 42 adjacent end walls 48, and locating pins 50 on sidewall 44. Further, four columns of cavities 52 are provided which extend through housing 38 from mating face 54 to the opposite rear face 56. Also provided are slots 58 A, B, C, D located between each row of four cavities 52. As used herein, columns refer to a line of objects; e.g., cavities 52, extending along the length of connector 36. Rows refer to a line of objects extending normal to the length of connector 36. The individual slots 58 open out onto face 54 as shown and extend rearwardly to merge into one slot 60 which extends across the width of housing 38 and opens out on rear face 56. The point of merger of slots 58 into single slot 60 is about on line with shoulders 40 as shown in FIG. 5. Further, slots 58 A, D open out on sidewalls 42, 44 respectively.

Rear face 56 is stepped as shown to accommodate signal conductors or contacts 78 (FIG. 4) which are located in cavities 52.

Also shown in FIG. 2 is support member 62 which is formed from steel. Member 62 includes an elongated flat portion 64, slots 66 adjacent each end, obliquely extending lances 68 at one end of slots 66 and card attachment straps 70. As shown, straps 70 extend obliquely away from and then bend down to parallel portion 64. The bent down portions strap 70, i.e., tabs 72, have hole 74 therethrough.

Figure 3:
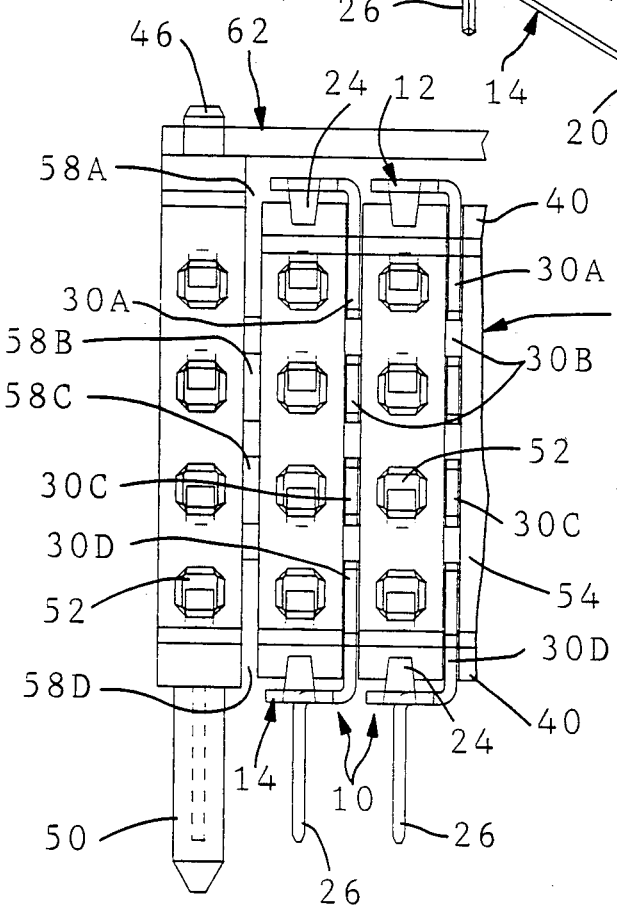
FIG. 3 is a plan view of the connector, reference plates and support member assembled into a unit.

As will be seen in FIGS. 3 and 4, support member 62 is attached to sidewall 42 of housing 38 by rail 46 entering slots 66 so that straps 70 extend across rear face 56. Retention is provided by lances 68 engaging rear face 56 on housing 38 and one end of rails 46 extending beyond slots 66.

Plates 10 are loaded into slots 58, 60 from rear face 56 of connector 36. Side portions 12, 14, 16 are on the outside of and are parallel to sidewalls 42, 44, fingers 30A-D enter slots 58 A-D respectively and the remaining portion of web 18 occupies slot 60 and extends rearwardly of face 56 as shown in FIG. 4. Lances 24 on side portions 12,14 abut shoulders 40 to keep plate 10 from being withdrawn.

FIG. 3 illustrates the location of fingers 30 A–D of reference plates 10 in connector 36 as seen from mating face 54. As an important feature of the invention, each contact 78 of each row is shielded from the contacts 78 in the adjacent row including those contacts in the middle columns. Thus all contacts 78 are shielded and can be dedicated to full signal usage.

FIG. 4 shows connector 36 with reference plates 10, support member 62 and printed circuit substrate or card 76 assembled together as one unit. Also shown are the signal contacts 78 of connector 36 which include receptacles 80 at one end and leads 82 at the other end. Card 76 is mounted onto connector 36 with locating pins 50 being received in holes 84, posts 26 on plates 10 being received in holes 86 and leads 82 of contacts 78 being received in holes 88. Posts 26 and leads 82 are soldered (not shown) in respective holes 86, 88. A screw (not shown) extending through card hole 90 and being threadedly received in hole 74 secures card 76 to support member 62.

FIG. 4 also shows second connector 92 which includes dielectric housing 94, conductive signal conductors or pins 96 and conductive reference contacts 98. Pins 96 and reference contacts 98 are arranged on the same pattern as contacts 78 and tab terminals 22 on plates 10 of connector 36.

Pins 96 include posts 100 which are received in contact receptacles 80 when connectors 36, 92 are mated. Reference contacts 98 include a clamp type receptacle 102 for receiving tab terminals 22 on plates 10. As shown, posts 100 and receptacles 102 are contained within cavity 103 of housing 94.

Connector 92 is mounted on a substrate; e.g., a backpanel (not shown) having circuits which are connected to circuits (not shown) on card 76 via mated signal contacts 78 and signal pins 96. Reference circuits (not shown) on the backpanel and card 76 are interconnected through plates 10 and reference contacts 98. As an alternative to the referencing function, plates 10 and contacts 98 may be used to carry supply power.

FIG. 5 is a similar view to FIG. 4 except that the section through connector 36 is taken to show plate fingers 30 A–D in relation to contacts 78 shown in phantom. That is, fingers 30 provides a barrier for each contact 78 in a given row relative to contacts 78 in an adjacent row.

Figure 6:
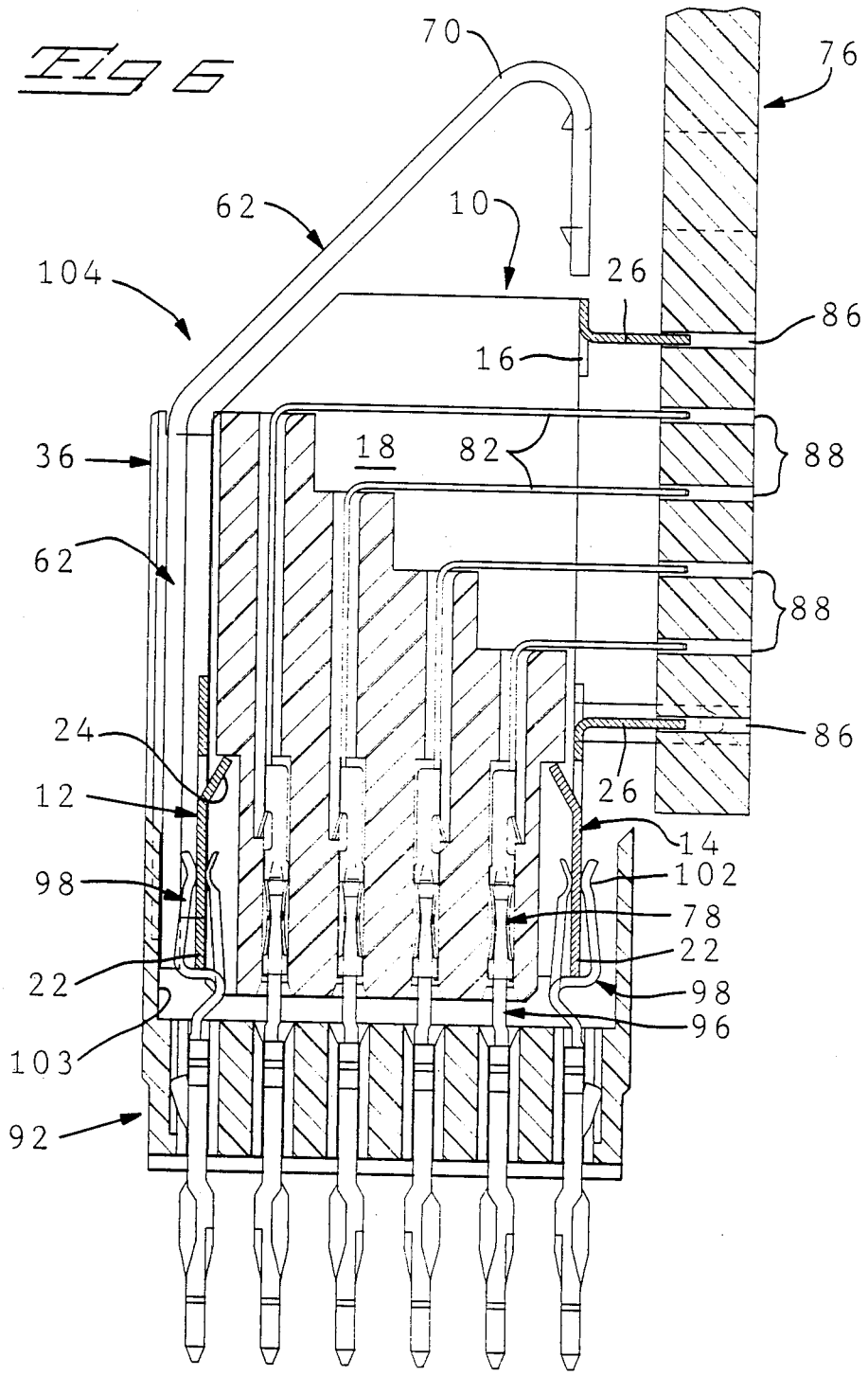
FIG. 6 is a side sectioned view of the mated connectors of FIGS. 4 and 5.
Figure 7:
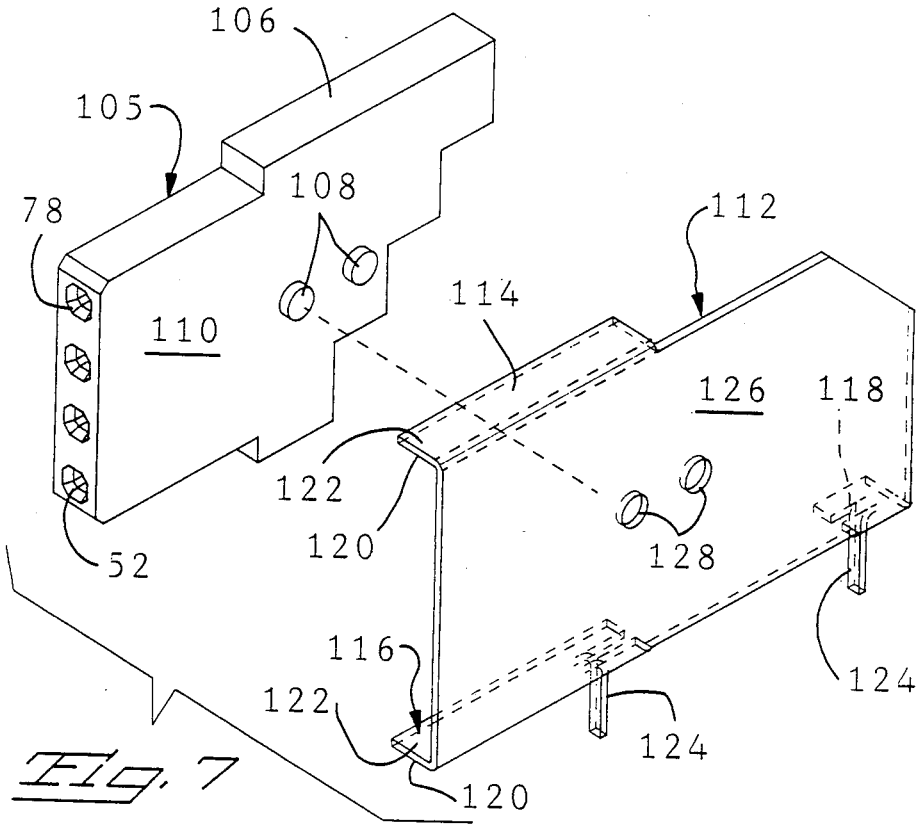
FIGS. 7, 8, 9 and 10 are perspective views of another embodiment of both the reference plate and connector.

FIG. 6 shows connector system 104 comprising mated connectors 36, 92. Posts 100 of signal pins 96 have been received in receptacles 80 of signal contacts 78 and tab terminals 22 of plates 10 have been received in receptacles 102 of reference contacts 98.

This connector system 104 provides improved signal transmission paths in an interconnect system including those having a very high density of signal pins and contacts. With reference plates 10 positioned between rows of mated signal pins and contacts, the connector system becomes a much more powerful tool without increasing the size of the connector or taking up additional panel space. The connectors 36, 92 have been shown for illustrational purposes in that such connectors contain a high density of signal paths.

The invention disclosed herein however can and will be used in other connectors and connector systems. Further, the invention can and will be used in connectors having more or less columns and rows of signal conductors than shown herein. For example, FIGS. 7-10 illustrate one alternate embodiment to connector 36. In this alternate embodiment, connector modules 105 include one row of contacts 78 in cavities 52. Housing 106 is provided with a pair of alignment pegs 108 on sidewall 110.

Reference plate 112 includes side portions 114, 116, 118 with free ends 120 on portions 114, 116 providing tab terminals 122. Posts 124 are struck from portions 116, 118 for insertion into holes 82 in card 76. Web 126 is provided with a pair of holes 128. The difference between plates 10 and 112 is the omission of fingers 30 on the latter.

Figure 8:
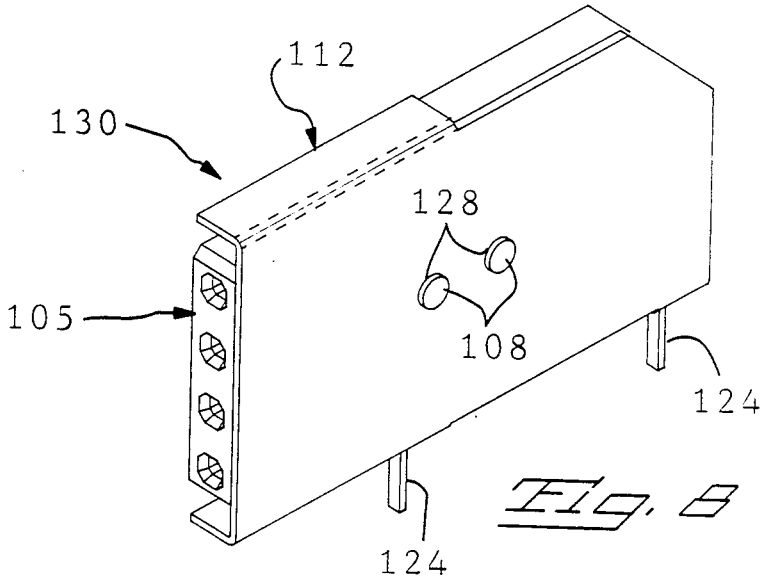

Plate 112 is mounted on the side of module 105 with pegs 108 entering holes 128 as shown in FIG. 8 to form modular unit 130. If desired, holes (not shown) may be provided in side wall 110 of housing 106 to receive pegs 108 on an adjacent housing 106.

Figure 9:
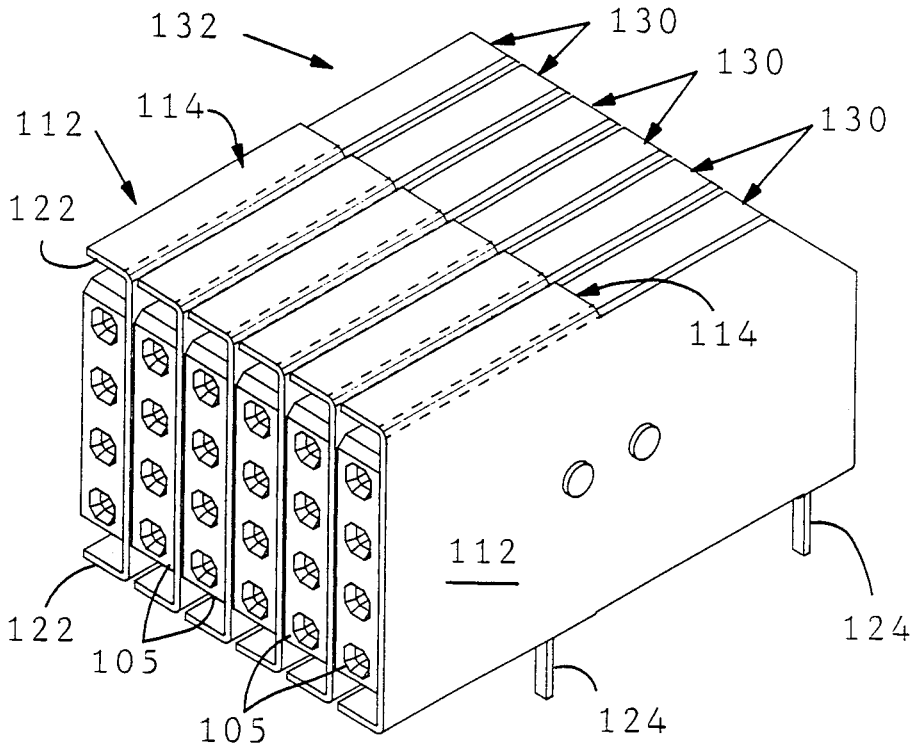
Figure 10:
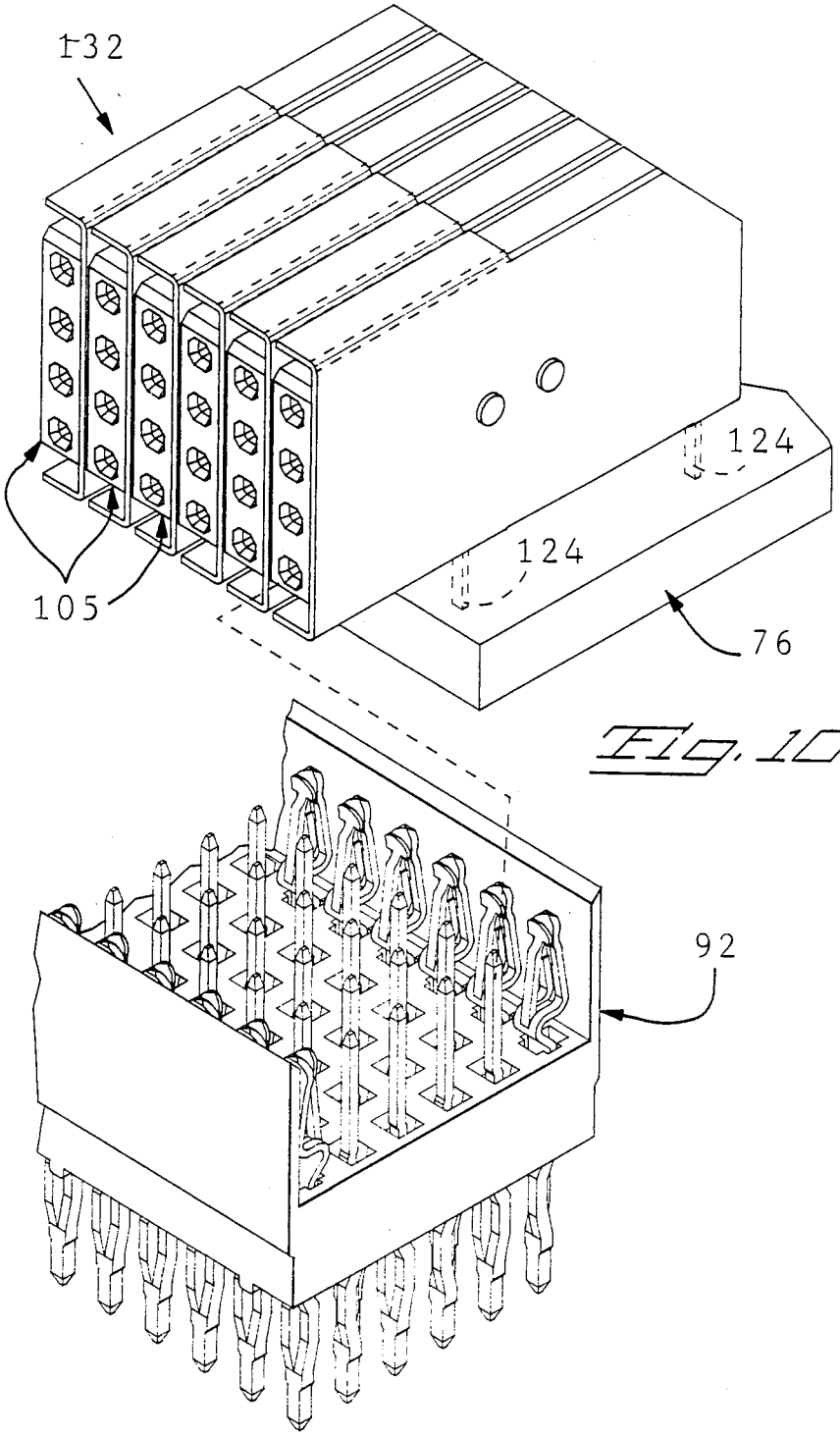

FIG. 9 shows a plurality of modular units 130 forming modular connector 132 and FIG. 10 shows card 76 attached to modular connector 132. FIG. 10 also shows a connector 92 which can receive either connector 36 or a modular connector 132 without modification.

The advantage of modular units 130 is that the length may be varied as required. In this respect, connectors 92 may be made in any given length.

Figure 11:
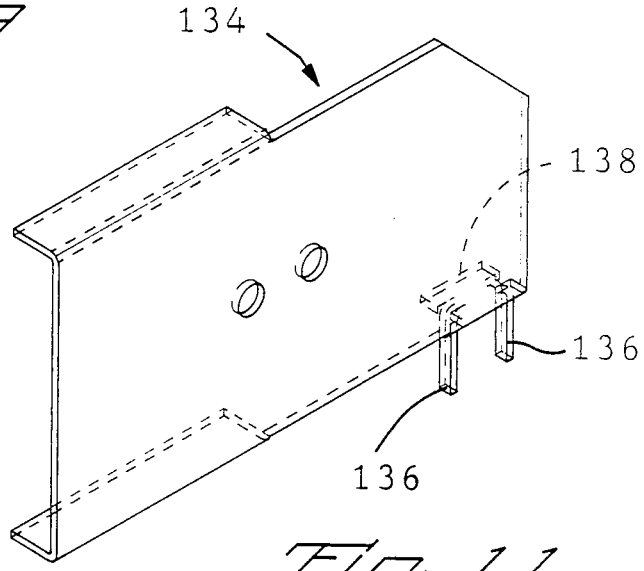
FIGS. 11, 12 and 13 are views of still other embodiments of the reference plate.

FIG. 11 shows reference plate 134 which is very similar to plate 112 except that posts 136 are struck from one side portion 138.

Figure 12:
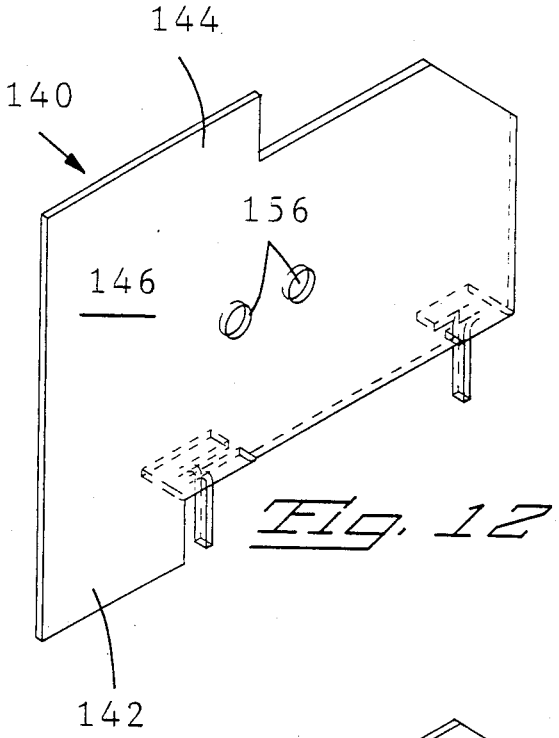
Figure 13:
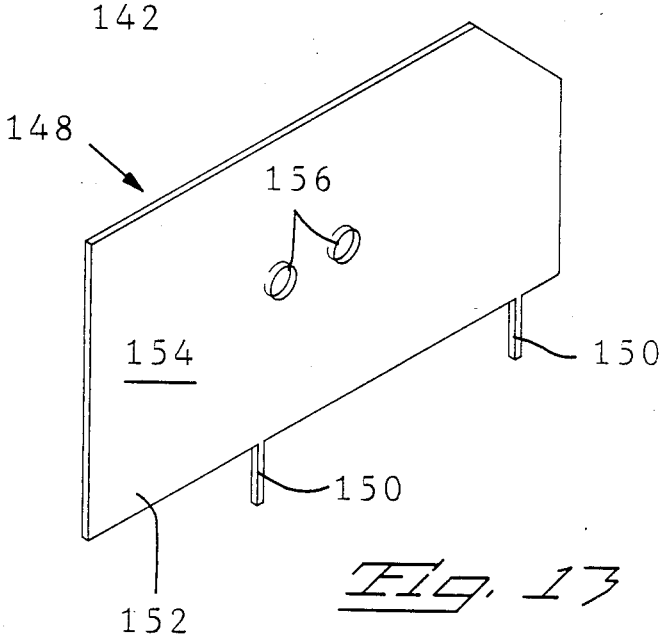

FIGS. 12 and 13 show other embodiments of the reference plate of the present invention. Plate 140 illustrated in FIG. 12, includes side portions 142, 144 which extend straight outwardly from web 146 rather than being bent ninety degrees relative thereto. Plate 148 shown in FIG. 13 illustrates an embodiment wherein posts 150 extend outwardly from edge 152 of web 154 rather than from bent in side portions as on plate 10. Both plates 140 and 148 include holes 156 for use with connector modules 105. However, plates 140 and 148 can be made to be used with connector 36 for example.

Another modification to plate 10 relates to fingers 30B and C and slots 58B and C. These two fingers can be merged into one (shown) and slots 58B and C merged into one larger slot to receive the larger finger.

Reference contacts 98 may be substituted with other contacts (not shown) which for example, slidingly engage side portions 12,14 to establish electrical contact therebetween. Similarly, free ends 20 of side portions 12,14 may be formed into shapes (not shown) other than being flat as shown so as to provide other methods of engaging reference contacts 98 or modifications thereof.

As noted above, reference plate 10 is preferably stamped and formed from conductive metal. Other conductive material may be used however such as metalized plastic.

As can be discerned, means for improving signal transmission paths for high density connectors and connector systems has been disclosed. Reference plates providing low inductance signal return paths are positioned between rows of signal contacts-pins and are electrically connected to reference circuits on circuit cards and backpanels associated with the connectors. This means of referencing provides return paths without the need to utilize any of the signal conductors as have been required in prior art connector systems. Accordingly, in some cases, there can be an increase of as much as double the number of signal conductors at an equivalent level of performance.

We claim:

1. A reference conductor in the form of a conductive plate for improving signal integrity in electrical connectors having rows of signal conductors and adapted to be mated to another connector, said plate comprising;

a web for being positioned between adjacent rows of signal conductors and having a width and length sufficient to provide a shield between at least a plurality of said signal conductors in said adjacent rows; and side portions, attached to respective sides of said web and adapted for extending beyond the ends of the rows of signal conductors, said side portions further being adapted for electrically engaging said web to reference circuits on a substrate which may be attached to the connector.

2. The reference conductor of claim 1 wherein said side portions are bent at about ninety degrees relative to said web.

3. The reference conductor of claim 2 further including an outwardly extending post on one side portion for being inserted into a hole in a substrate and being electrically engaged to a reference circuit thereon.

4. The reference conductor of claim 3 further including electrically engaging means on at least one side portion for electrically engaging reference contacts on the mating connector.

5. An electrical connector system comprising;

a first connector having a front face, a rear face and an array of slots formed therein extending in respective surfaces orientated to pass between the front and rear faces;

an array of first signal contacts mounted in the first connector and electrically accessible from the front face;

an array of second contacts mounted in the slots of the first connector, each of said second contacts comprising a respective plate disposed between adjacent ones of the first contacts;

a second connector;

an array of third contacts mounted in the second connector and positioned to electrically interconnect with respective ones of the first contacts when the connectors are mated; and an array of fourth contacts mounted in the second connector and positioned to electrically interconnect with respective ones of the second contacts when the connectors are mated, said fourth contacts comprise a pair of opposed beams configured to grip the respective plate therebetween.

6. The invention of claim 5 wherein each of the first contacts comprises a receptacle for receiving the respective third contact, and wherein each of the third contact comprises a pin.

7. The invention of claim 5 wherein each of the plates is "C" shaped in cross section and defines a web section and two opposed side portions, wherein the side portions extend beyond the first connector, and wherein each of the fourth contacts comprises a pair of opposed beams configured to grip the respective side portion therebetween.

8. An electrical connector system comprising:

a first connector comprised of a plurality of modules secured together side to side, each module having a front face and a line of cavities located between respective ends of said module;

an array of first signal contacts mounted in said cavities of each module and electrically accessible from the front face;

a plurality of second contacts, each mounted in a side of each module, each second contact comprising a plate of conductive material which covers the side of said module and further extends beyond an edge thereof;

a second connector;

an array of third contacts mounted in the second connector and positioned to electrically interconnect with respective ones of the first contacts when the connectors are mated; and an array of fourth contacts mounted in the second connector and positioned to electrically interconnect with respective ones of the second contacts when the connectors are mated.

9. A reference conductor for improving signal integrity in electrical connectors having rows of signal conductors by providing a low inductance signal return path, said reference conductor comprising a conductive plate having a web for being positioned between adjacent rows of signal conductors and a portion attached to and extending along one side of said web, said web having a length and width sufficient to provide a substantial shield between the adjacent rows, said plate further having first contact means thereon for electrically engaging reference circuits on a substrate which may be attached to the connector and second contact means for electrically engaging a conductive reference contact in a mating electrical connector and with said portion carrying at least one of said first and second contact means thereon.

10. The reference conductor according to claim 9 with said portion being adapted for extending beyond the end of adjacent rows of signal conductors.

11. The reference conductor according to claim 10 with said portion bent at about ninety degrees relative to the plane of said web.

12. The reference conductor according to claim 11 wherein said web includes a second portion on an opposing side.

13. The reference conductor according to claim 10 wherein both portions have second contact means thereon.

14. The reference conductor according to claim 13 wherein said second contact means include tab-like means adapted to be slidingly received in a two-beam receptacle.

* * * * *

UNITED STATES PATENT OFFICE

CERTIFICATE OF CORRECTION

Patent No. 4,846,727 Dated July 11, 1989

Inventor(s) Douglas W. Glover & Richard F. Granitz

It is certified that error appears in the above-identified patent and that said Letters Patent is hereby corrected as shown below:

The serial number on the front page of the patent should be: 179,599 and not 179,589.

In column 6, line 54, claim 13, claim "10" should be claim "12".

Signed and Sealed this

Twelfth Day of June, 1990

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,846,727

DATED : July 11, 1989

INVENTOR(S) : Douglas Wade Glover et al.

It is certified that error appears in the above-identified patent and that said Letters Patent is hereby corrected as shown below:

On the title page, item (21):

The Serial Number "179,589" should be --179,599--.

Signed and Sealed this

Ninth Day of November, 1993

Bruce Lehman

*Attest:*

BRUCE LEHMAN

*Attesting Officer*

*Commissioner of Patents and Trademarks*